United States Patent [19]

Lucas

[11] 4,053,054

[45] Oct. 11, 1977

[54] PACKAGE HAVING INDIVIDUAL ISOLATED CELLS

[75] Inventor: Bernard Lucas, Rouen, France

[73] Assignee: Padeg A.G., Moehlin, Switzerland

[21] Appl. No.: 620,498

[22] Filed: Oct. 7, 1975

[51] Int. Cl.[2] ..... B65D 85/56

[52] U.S. Cl. ..... 206/534; 206/538; 206/551; 206/459; 220/21

[58] Field of Search ..... 206/538, 532, 534, 551, 206/459; 220/20, 21; 116/121

[56] References Cited

U.S. PATENT DOCUMENTS

| | | | |
|---|---|---|---|
| 231,478 | 8/1880 | Curry | 206/538 |
| 2,485,051 | 10/1949 | Joslin | 220/20 |
| 2,573,311 | 10/1951 | Cupler | 206/459 |
| 2,953,242 | 9/1960 | Shaw | 206/534 |
| 3,199,489 | 8/1965 | Ruoss | 206/538 |
| 3,334,731 | 8/1967 | Dale | 206/538 |
| 3,393,795 | 7/1968 | Conert | 206/534 |
| 3,398,827 | 8/1968 | Laskin | 206/551 |
| 3,557,747 | 1/1971 | Rigney | 116/121 |
| 3,596,629 | 8/1971 | English | 206/534 |
| 3,904,075 | 9/1975 | Richardson | 116/121 |

*Primary Examiner*—Herbert F. Ross
*Attorney, Agent, or Firm*—Haseltine, Lake & Waters

[57] ABSTRACT

A package having a plurality of distinct cells and a support to which the cells are connected so as to be disposed around a common center. At least one reference mark is placed on the package to establish the contents of the cells in a determined order in one or more sequences and at least one second mark capable of determining the position of the cells with respect to a fixed point. In use, the marks are read by a reading device and, depending upon a selection which is made, a particular cell is perforated to allow the contents thereof to be distributed.

9 Claims, 2 Drawing Figures

FIG. 1
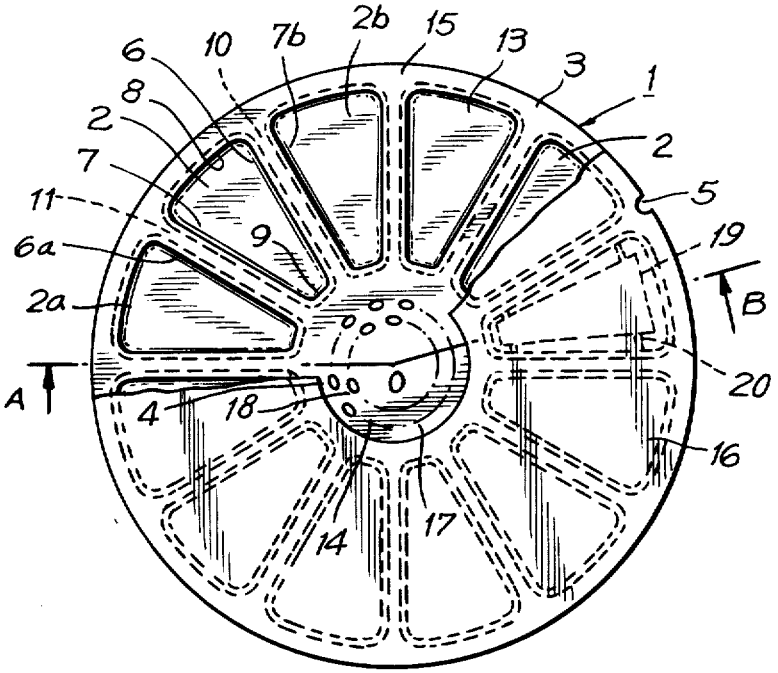
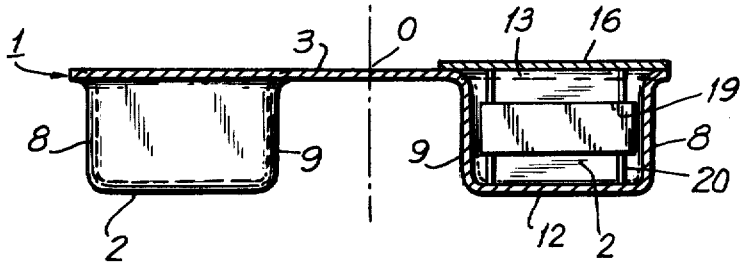
FIG. 2

PACKAGE HAVING INDIVIDUAL ISOLATED CELLS

FIELD OF THE INVENTION

The present invention relates to a package having cells for diverse products, such as food products or chemical products, and particularly for products adapted for photographic uses.

BACKGROUND AND SUMMARY OF THE INVENTION

The object of the package according to the invention is to assure the transport and conservation of determined quantities of products, identical or different, introduced into the cells of the package, the contents of one cell being isolated and separately utilized.

Not only does the package according to the invention serve for transport and simple storage, but it is also particularly adapted for use in automatic distributing and/or utilization machines for one or more products contained in the package. In addition, the package can be provided with means effecting, according to a program, the distribution and/or the utilization of these products.

According to the invention, the package comprises distinct cells and a support to which these cells are connected in a manner disposed around a common center, the support comprising at least one reference mark capable of determining the disposition of the cells in a determined order in one or more sequences as well as at least one second reference mark susceptible of determining the position of the cells with respect to a fixed point.

The invention further consists of certain additional means mentioned hereafter and employed at the same time as the main arrangement described hereinabove.

The invention contemplates, more especially, certain modes of application and the realization thereof. It contemplates, even more particularly, new industrial products, packages with cells of the type in question, the assembly containing them as well as the elements and tools proper for their establishment.

By way of example, and to facilitate the comprehension of the invention, there is given hereafter a description of particular embodiments of the invention shown in schematic manner and non-limitating fashion in the attached drawings.

BRIEF DESCRIPTION OF THE DRAWING

FIG. 1 is plan view of a package with cells according to the invention, the cover of the package being partially shown; and FIG. 2 is a section taken in FIG. 1 along line A-O-B.

DETAILED DESCRIPTION

According to the invention, the package 1 comprises, on the one hand, distinct cells 2, and on the other hand, a support 3 to which the cells are connected to be disposed around a common center O. The support 3, which in the particular embodiment is a circular plate, comprises at least one reference mark such as 4 capable of determining the disposition of the cells in a determined order in one or a plurality of sequences, as well as a second mark such as 5 capable of determining the position of the cells with respect to a fixed point.

In the illustrated example, the cells 2 are formed as hollows below the flat support 3. The cells when viewed in section parallel to the surface of the support forms a curved trapezoid bounded by two radial lines 6 and 7 and two circular arcs 8 and 9 centered on the axis perpendicular to the support 3 passing through the common center O. The radial walls corresponding to the radial lines 6 and 7 of a cell are separated by a radial space 10 or 11 of adjacent radial walls 7*b* and 6*a* of neighboring cells 2*b* and 2*a*, situated on opposite sides of the cell 2.

Each cell is closed at its lower end by a bottom wall 12 parallel to the flat support 3 or inclined with respect thereto. The side walls and the bottom of the cells are sealed, each cell having an opening 13 opposite its base. In the illustrated embodiment, all of the openings 13 are in the plane of support 3, the totality of the package 1 constituting a substantially cylindrical body with radial cells defined between an internal zone 14 and a peripheral zone 15.

The package 1 can have a variable number of cells 2 whose angular distribution can be uniform or not. Sections taken parallel to the surface of the support 3 of the cells can be either equal or not and the same is true of the depth of the cells. One cell can be subdivided to form at least two compartments separated by a partition.

The openings 13 of the cells are closed by one or a plurality of connected closure members, for example, by a cover 16 common to all of the cells, sealed on the surface of the flat support 3. The closure members need not extend into the internal zone 14 of the package and thus can form, for example, a circular ring as shown in the drawing.

The products to be packaged, identical or different, are placed in the cells 2 either directly in the cell or in the compartments of the cell or in one or a plurality of sealed chambers, such as 19, placed in the cell and positioned in sealing manner by projecting portions 20, these chambers constituting another form of compartment for the cell.

The removal of the products contained in one cell of the package is effected according to the nature of the products and the utilization thereof by tearing the closure member, such as the cover 16, or by forming openings in the bottom wall 12 of the cell and the portion of the closure member such as the cover 16 corresponding to this cell, or by forming openings in the circular walls corresponding to the arcs of the circles 8 and 9. The sealed chambers such as 19 can also be provided with openings closed by a closure member.

The openings in question can be provided in advance and closed by an obturation member which is pierced or torn at the proper time. These openings can also result from the perforation of the bottom wall 12 of the cell or of the portion of the corresponding closure member or of the perforation of the circular walls corresponding to the arcs of the circles 8 and 9 of from the perforation in the chambers 19 if they exist.

The package according to the invention can be formed with the exception of its one or more closure members and the chambers 19, from a single element by molding or forming an appropriate material, such as, cardboard, metal sheets and particularly by molding a plastic material such as polystryrene, or a composite product.

It is also possible to effect the formation of the cells 2 in the form of individual sealed volumes enclosing the desired products, these cells being then fixed, by any known suitable means, such as adhesives, to the flat support 3.

At least one of the walls of the cells can have an exterior surface provided with projections and depressions.

One of the characteristics of the package according to the invention is that it comprises a least one first reference mark capable of determining the placement of the cells in a determined order and in one or more sequences, as well as at least one second reference mark capable of determining the position of the cells with respect to a fixed point.

These reference marks can be constituted by readable inscriptions exposed to view or to photoelectric cells, by perforations, notches, magnetic inscriptions, or other known means which can be scanned, detected and exploited mechanically or electrically, permitting thus the particular utilizations of the package and specifically according to a program. The realization of such program is particularly simplified by reason of the circular form of the package which permits convenient rotation thereof around an axis passing through its center O.

The reference mark capable of determining the placement of the cells (mark 4) can be situated in the vicinity of the common center O, but it could also be situated at the periphery of the package. This reference mark can be situated on a cell.

The mark capable of determining the position of the cells is eccentric with respect to the center of the package. It can, as is the mark 5, be situated at the periphery of the package and be provided on the support 3. It can also be provided on a closure member of the cells such as the cover 16. This mark can also be constituted by a portion of the support which remains visible after placement of a closure member on the cells.

In the illustrated embodiment, the radial spaces such as 10 or 11 separating the cells 2 are identical. These spaces can obviously be different and can constitute the marks capable of determining the placement or the position of the cells.

The package 1 can comprise one or a plurality of marks for each cell 2, each mark being conceived as a function of the product which should be contained in the corresponding cell, the assembly of these marks constituting at least one program.

The aforementioned marks and particularly when they are in the form of optical inscriptions, perforations, notches, bosses, magnetic inscriptions, etc. are susceptible of being detected and employed in an apparatus or an arrangement receiving the package, the function of the said apparatus or arrangement being subordinated to the marks. Thus, marks, such as perforations, can be disposed on concentric circles 17, 18 having their center at O. By turning the package around an axis passing through O perpendicular to the flat support 3, the marks disposed on the circles 17, 18 control the diverse functions of the apparatus or the arrangement receiving the package.

It will be seen that the invention is not limited to the embodiments and utilizations indicated and it embraces also all variations as will become evident to those skilled in the art.

What is claimed is:

1. A package comprising a single piece of material constituting a plurality of distinct cells and a support to which the cells are connected in a manner disposed around a common center, each cell comprising a bottom wall and side walls and having an opening opposite the bottom wall, the openings of the cells lying in a common plane, all the cells being integrally connected one to the other by said support which is common to all cells and is situated in the plane of the openings, the cells and support constituting a substantially cylindrical body having a central axis with the cells disposed around said axis and extending radially and axially thereof and with an internal zone and a peripheral zone defined on said support, a ring shaped cover fixed on said cells for sealing same, said support having at least one first reference mark capable of determining the disposition of the cells in a determined order in one or more sequences as well as at least one second mark capable of determining the position of the cells with respect to a fixed point, at least one cell comprising at least two compartments, said compartments being constituted by the cell itself on the one hand and at least one sealed chamber placed in said one cell on the other hand, said sealed chamber within said cell containing a sealed product for subsequent utilization.

2. A package according to claim 1, wherein the mark capable of determining the disposition of the cells is situated in the vicinity of the common center.

3. A package according to claim 1, wherein the mark capable of determining the position of the cells in eccentric with respect to the center of the package.

4. A package to claim 1, wherein the mark capable of determining the position of the cells is situated at the periphery of the package.

5. A package according to claim 1, wherein the mark capable of determining the position of the cells is on the cover member for the cells.

6. A package according to claim 1, wherein the mark capable of determining the position of the cells is constituted by a support portion which remains visible after placement of the cover member for the cells.

7. A package according to claim 1, wherein one said first mark is provided for each cell, each such first mark being related to the function of the product contained in the corresponding cell, the assembly of first marks constituting at least one program.

8. A package according to claim 1, wherein the first and second marks are capable of being detected and utilized by an apparatus whose operation is subordinated to the marks.

9. A package according to claim 1 wherein each cell is opened at the time of utilization for the extraction of the product which it contains by perforation of the cell.

* * * * *